US005333786A

United States Patent [19]

Gant et al.

[11] Patent Number: 5,333,786

[45] Date of Patent: Aug. 2, 1994

[54] FUEL INJECTION DEVICE FOR AN INTERNAL COMBUSTION ENGINE

[75] Inventors: Gary L. Gant; George L. Muntean; Jeffrey C. Osborn, all of Columbus, Ind.

[73] Assignee: Cummins Engine Company, Inc., Columbus, Ind.

[21] Appl. No.: 71,514

[22] Filed: Jun. 3, 1993

[51] Int. Cl.[5] ..... F02M 47/02

[52] U.S. Cl. ..... 239/89; 239/90; 239/95; 123/446; 123/501

[58] Field of Search ..... 239/89-92, 239/95, 96, 533.9; 123/446, 501

[56] References Cited

U.S. PATENT DOCUMENTS

| | | | |
|---|---|---|---|
| 3,257,078 | 6/1966 | Mekkes | 239/90 |
| 3,635,403 | 1/1972 | Hofken et al. | 239/90 |
| 4,281,792 | 8/1981 | Sisson et al. | 239/90 |
| 4,398,670 | 8/1983 | Hofmann | 239/533.9 |
| 4,410,137 | 10/1983 | Perr | 239/95 |
| 4,640,252 | 2/1987 | Nakamura et al. | 123/446 |
| 4,903,896 | 2/1990 | Letsche et al. | 239/88 |
| 5,056,488 | 10/1991 | Eckert | 239/88 |
| 5,067,464 | 11/1991 | Rix et al. | 239/89 |

*Primary Examiner*—Karen B. Merritt
*Attorney, Agent, or Firm*—Woodard, Emhardt, Naughton, Moriarty & McNett

[57] ABSTRACT

A fuel injector for an internal combustion engine includes a main body including a timing bore, a timing plunger disposed in the timing bore, an electronically-operated solenoid valve assembled to the main body, a nozzle having a needle bore and an injection needle disposed in the needle bore which needle is operable under certain conditions to lift so as to initiate fuel injection. Disposed between the main body and the nozzle member is a one-piece adapter which is designed to include an axially-extending metering bore and a needle spring cavity. A metering plunger is disposed within the metering bore and a biasing spring is disposed within the needle spring cavity. At the base of the needle spring cavity is a button which serves as a direct abutment interface between the top of the needle and the bottom of tile biasing spring. The thickness of the button controls the preload on the spring and this is the force which must be overcome by fuel pressure present in the needle spring cavity in order to allow the needle to lift so as to create an injection opening between the needle and the tip of the nozzle for the fuel at high pressure to be injected.

22 Claims, 6 Drawing Sheets

FUEL INJECTION DEVICE FOR AN INTERNAL COMBUSTION ENGINE

BACKGROUND OF THE INVENTION

The present invention relates in general to fuel injection systems and devices for internal combustion engines. More specifically tile present invention relates to an improved mechanical design for portions of a fuel injection device so as to provide a more reliable, lower cost fuel injector.

Many motor vehicles, whether compression ignition or spark ignition engines, are provided with electronic fuel injection systems in order to satisfy the need for precise and reliable fuel delivery into the cylinders of the engines. Precision and reliability are demanded to address the goals of increasing fuel efficiency, maximizing power output, and controlling undesirable products of combustion.

Several electronic fuel injection systems designed for internal combustion engines use a mechanical linkage from the engine in order to pressurize the fuel charge. Using mechanical pressurization, an extremely high injection pressure, now often exceeding 20,000 psi (13,800 Newtons per square centimeter) and occasionally reaching a transient peak value of 23,500 psi (16,200 Newtons per square centimeter), is developed within the timing chamber of the injector. A higher fuel injection pressure provides a cleaner exhaust because particulate emissions are reduced, and is thus desirable to meet the tightened emissions standards which are being and will be imposed on motor vehicles.

One feature of the electronic fuel injection system which can be regarded as the predecessor to the present invention is the addition of a solenoid control valve to the top area of the injector. The predecessor injector, as well as the fuel injection device of the present invention, uses cam shaft actuation in order to build injection pressures. While much of the operation of the fuel injection device of the present invention is virtually identical to the predecessor design, certain improvements have been made in order to improve the quality and to lower the cost. The number of parts has been reduced and a plurality of high pressure seal joints have been eliminated. The reduction in the trapped volume, a consequence of the present invention, improves performance of the fuel injection device of the present invention over that of the predecessor design.

In addition to the predecessor injector which has been mentioned above and which is described in greater detail hereinafter, there are a wide variety of other fuel injection systems and devices. A representative sampling of these other systems and devices is provided by the following listing:

| U.S. Pat. No. | Patentee | Issue Date |
|---|---|---|
| 4,281,792 | Sisson et al. | Aug. 4, 1981 |
| 4,398,670 | Hofmann | Aug. 16, 1983 |
| 4,410,137 | Perr | Oct. 18, 1983 |
| 4,640,252 | Nakamura et al. | Feb. 3, 1987 |
| 4,903,896 | Letsche et al. | Feb. 27, 1990 |

As will be apparent from the description of the present invention as set forth hereinafter, there are a number of structural differences between the present invention and the listed sampling of earlier injection devices as well as the predecessor injector design. For example, neither the predecessor design nor any of the listed references disclose a unit fuel injector having a one-piece adapter positioned between an upper body and a lower nozzle wherein the adapter includes both a needle valve spring cavity and a second cavity for receiving an injector (metering) plunger. Further, neither the predecessor design nor any of the listed references disclose the use of a stepped button or a straight button and stem combination positioned in the spring cavity for setting the lift of the injector needle.

SUMMARY OF THE INVENTION

A fuel injector for an internal combustion engine according to one embodiment of the present invention comprises a main body having an axially-extending timing bore, a timing plunger disposed within the timing bore, a nozzle member having an axially-extending needle bore, an injection needle disposed in the needle bore, an adapter positioned between the nozzle member and the main body, the adapter including an axially-extending metering bore and a needle spring cavity, a retainer disposed about the nozzle and the adapter and attached to the main body, a metering plunger disposed within the metering bore, a biasing spring disposed within the needle spring cavity and control means for limiting the upward travel of the needle in response to the fuel pressure in the needle bore.

One object of the present invention is to provide an improved fuel injector.

Related objects and advantages of the present invention will be apparent from the following description.

DESCRIPTION OF THE PREFERRED EMBODIMENT

Figure 1:
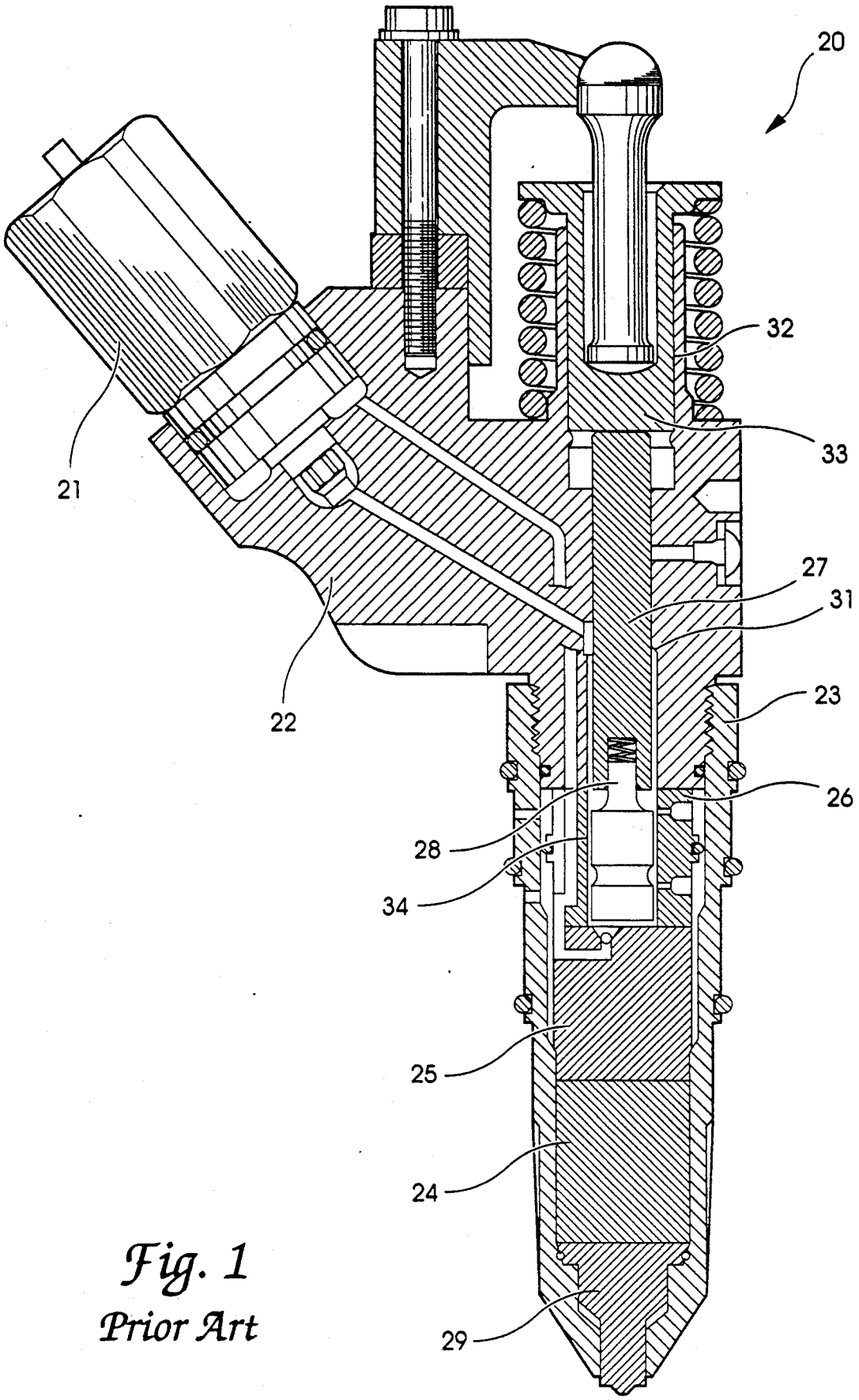
Fig. 1 Prior Art
FIG. 1 is a front elevational view in full section of a fuel injector which represents a predecessor construction to the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 1A:
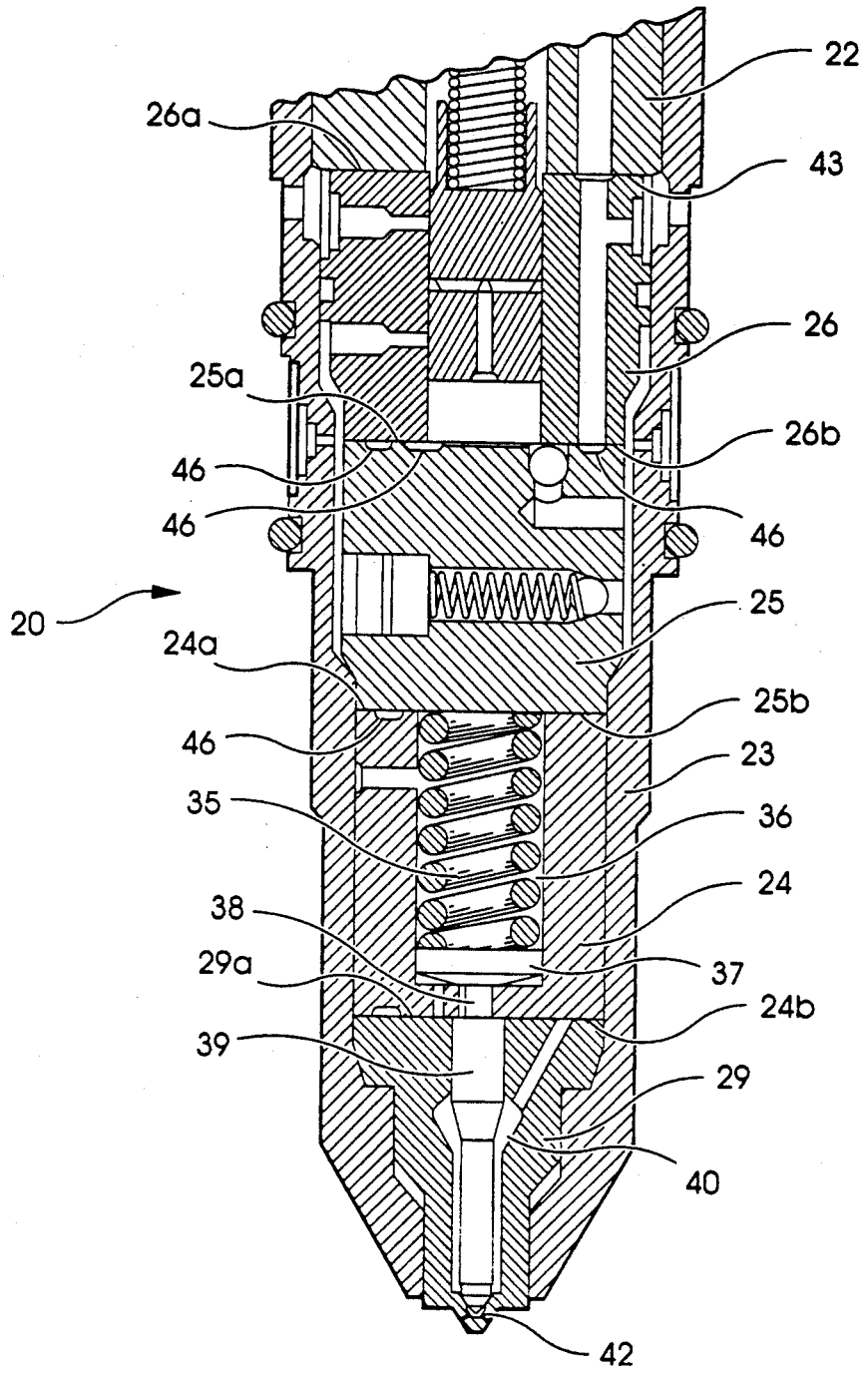
Fig. 1A Prior Art
FIG. 1A is a partial side elevational view in full section of the lower portion of the FIG. 1 fuel injector.
Figure 1B:
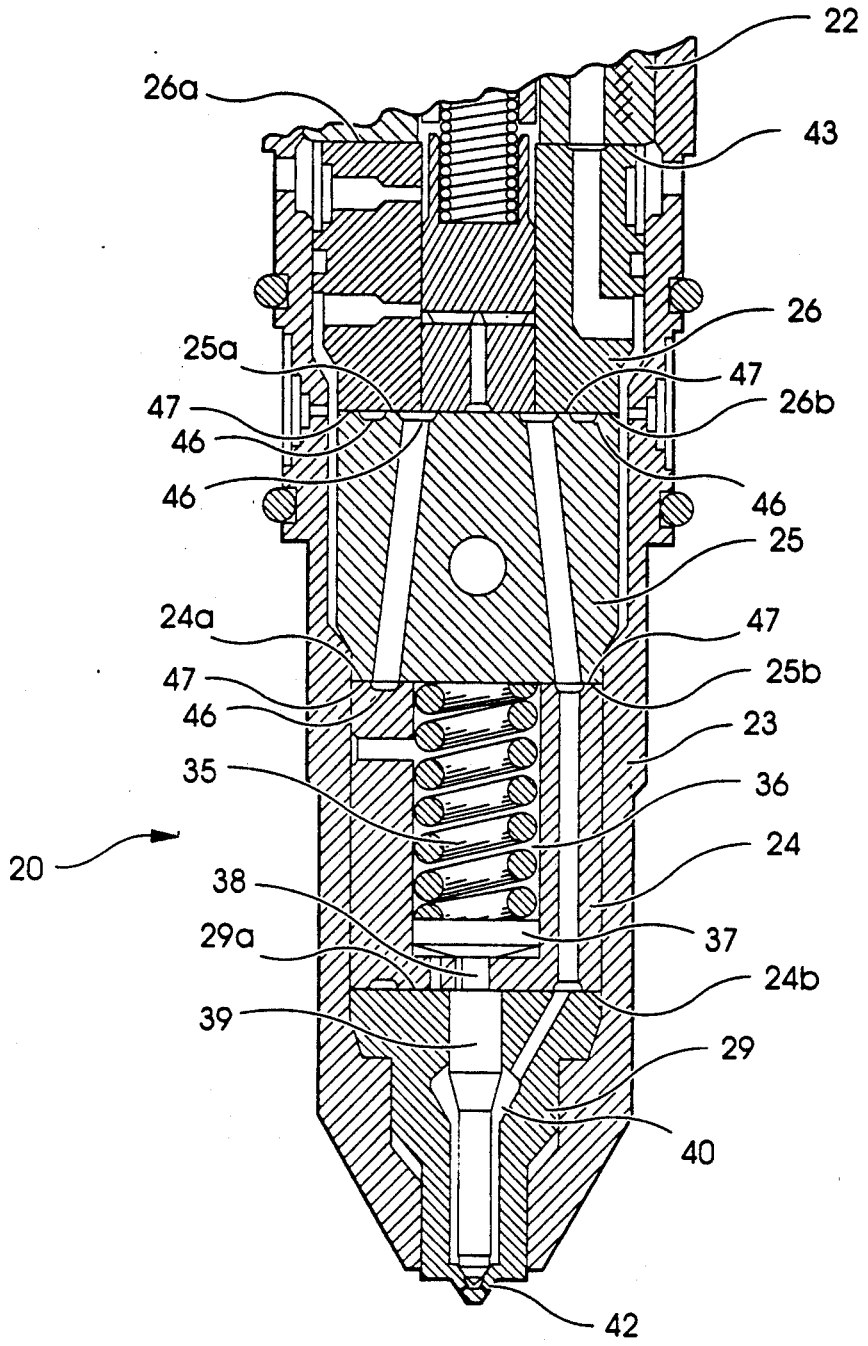
Fig. 1B Prior Art
FIG. 1B is a partial front elevational view in full section of the lower portion of the FIG. 1 fuel injector.

Referring to FIGS. 1, 1A and 1B there is illustrated a fuel injector 20 which represents a predecessor construction to the present invention and as such is labeled "PRIOR ART". Injector 20 is electronically controlled and includes a solenoid control valve 21 which is assembled into and cooperates with injector body 22. Some of the remaining structural component of injector 20 include nozzle retainer 23, spring cage 24, spacer 25, metering barrel 26, timing plunger 27, metering plunger 28 and nozzle 29.

Injector body 22 includes two coaxially and communicating central cylindrical bores of differinq inner diameters. The first cylindrical bore 31 slidingly receives the timing plunger 27, while the second cylindrical bore 32 slidingly receives a coupling member 33. The metering plunger 28 is slidingly received in cylindrical bore 34 which is defined by the metering barrel 26.

A fuel injector of the type illustrated in FIG. 1 is generally disclosed in U.S. Pat. No. 5,067,464, which issued Nov. 26, 1991 to Rix, et al. This United States patent is hereby expressly incorporated by reference specifically for the benefit of the FIG. 1 disclosure and for the specification text set forth in columns 4 thorough 7. Although there is a great deal of similarity between FIG. 1 of this disclosure and FIG. 1 of the referenced Rix patent, and while the sequence and theory of operation are virtually identical, the Rix FIG. 1 refers only generally to a nozzle assembly 22 and to a nozzle spacer 23 (see FIG. 1 of Rix). Since the nozzle assembly of Rix is not particularly relevant to the claimed invention of Rix, a general reference is all that was necessary. However, the present invention includes a redesign of the Rix FIG. 1 structure as disclosed herein and of similar injectors and thus the specific structure of the nozzle assembly and the component parts which comprise that nozzle assembly become quite relevant. These component parts are illustrated in FIGS. 1A and 1B.

FIGS. 1, 1A and 1B herein are based generally on FIG. 1 of the Rix patent (5,067,464). The nozzle assembly 22 of the Rix patent has been expanded to include, in addition to barrel 26, nozzle retainer 23, spring cage 24 and spacer 25. A review of these components and their assembled relationship will be helpful in appreciating the improvements which have been made to this design by the present invention.

The details, characteristics and functions of metering barrel 26 are set forth in the referenced Rix patent. Spring cage 24 houses injector spring 35 which is seated within cavity 36 and rests against button 37. Button 37 is acted upon by the smaller diameter stem 38 of needle 39 (nozzle valve). An increase in fuel pressure in cavity 40 of nozzle 29 lifts needle 39 causing stein 38 to push upwardly against button 37 which in turn compresses spring 35. As this occurs, a charge of fuel is injected out from nozzle tip 42, the pressure is reduced and the spring 35 forces a downward return of needle 39 into a closed of sealed configuration nozzle tip 42.

As illustrated in FIGS. 1A and 1B the upper, substantially planar surface **26*a* of metering barrel 26 fits tightly up against the lower, substantially planar surface 43 of injector body 22. In a similar fashion the upper, substantially planar surface 25*a* of spacer 25 fits tightly up against the lower, substantially planar surface 26*b* of barrel 26. Likewise, the upper substantially planar surface 24*a* of spring cage 24 fits tightly up against the lower, substantially planar surface 25*b* of spacer 25. The final interfit has the upper, substantially planar surface 29*a* of nozzle 29 fitting tightly up against the lower, substantially planar surface 24*b* of spring cage 24. This assembled stack of injector components are held in place by the design nozzle retainer 23 which is threadedly received by the injector body 22**.

These abutting, substantially planar surfaces need to be precisely machined and ground flat to very tight tolerances in order to create a tightly sealed interface and preclude fuel leakage.

Before discussing the changes and improvements to the injector design of FIGS. 1, 1A and 1B, certain design features and requirements need to be mentioned. As illustrated in FIGS. 1A and 1B herein, there are various grooves or pockets 46 machined down into the top, substantially planar surfaces of spacer 25 and spring cage 24. These pockets 46 are created by machining grooves and by vertical drilling. These pockets 40 are in flow communication with the various passageways and cavities of injector 20 through which fuel flows. These pockets enable the required fuel flow communication between the stacked components without requiring the use of dowels tot precise alignment. These pockets increase the trapped volume of fuel and thereby reduce the hydraulic spring rate which reduces the efficiency. Additionally, the abutting surfaces between the spacer 25 and metering barrel 26 and between the spacer 25 and spring cage 24 have to be adequately sealed so as to prevent fuel leakage. There are two abutment interfaces and four high pressure seal surfaces (one on each side of each abutment interface) identified generally by reference numeral 47 and specifically by **25*a*, 26*b*, 24*a* and 25*b***.

Figure 2:
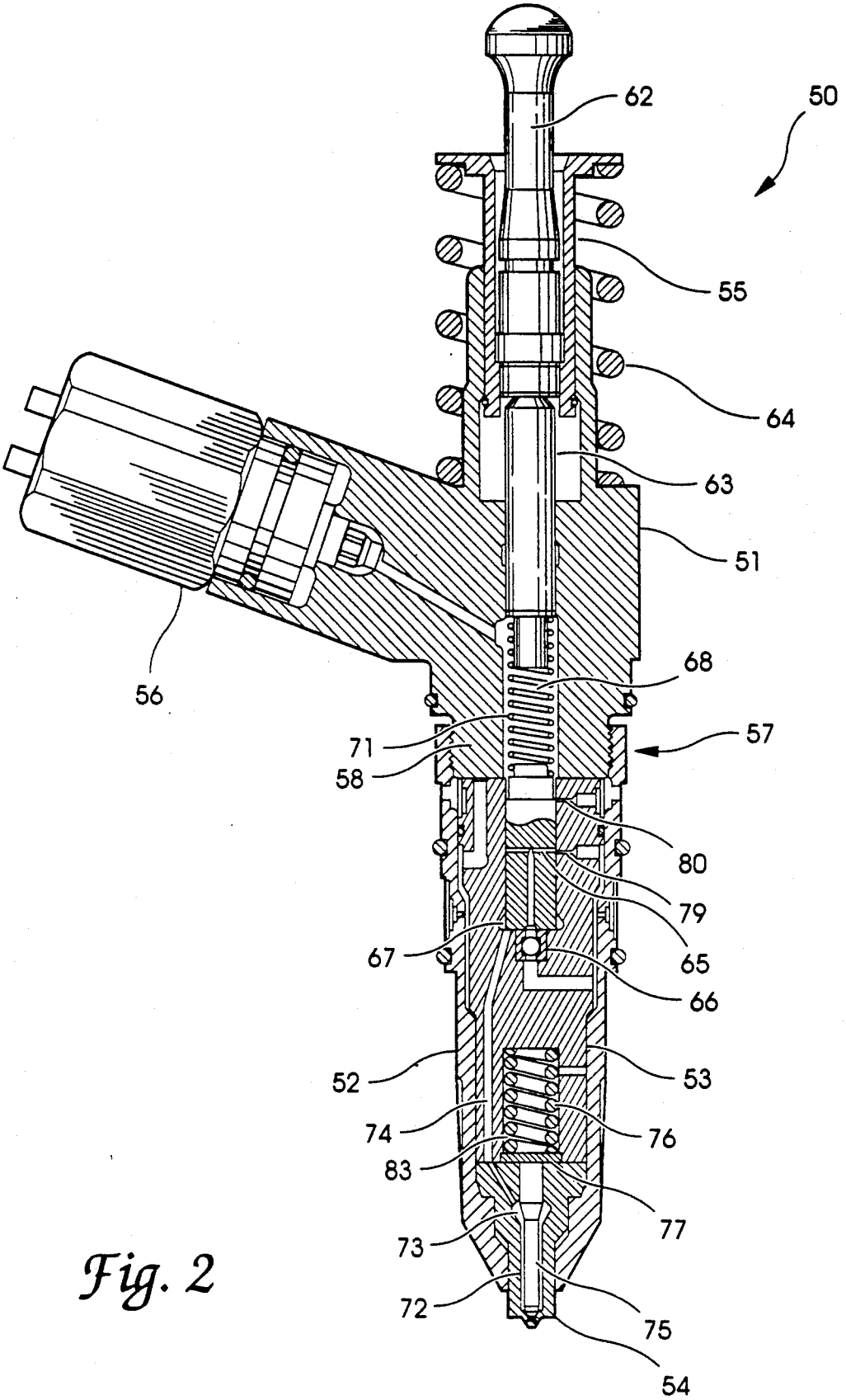
FIG. 2 is a front elevational view in full section of a fuel injector according to a typical embodiment of the present invention.

Referring to FIG. 2 there is illustrated a fuel injection device 50 which is designed and constructed in accordance with the present invention. While the operation of device 50 is virtually the same as the operation of injector 20, as far as the unit injection, there are important structural differences. Fuel injector (i.e., injection device) 50 includes main body 51, retainer 52, adapter 53, nozzle 54, coupling 55 and solenoid valve 56. The nozzle 54, adapter 53 and the main body 51 are clamped together by retainer 52. As illustrated, the interior of retainer 52 is sized and shaped to receive adapter 53 and at the tip of retainer 52, to receive nozzle 54. The upper end 57 of the retainer 52 internally threaded and the lower end 58 of the main body 51 is externally threaded so as to mate with the corresponding retainer threads. The upper most surface of the nozzle is substantially flat and the lower most surface of the adapter 53 is substantially flat such that these two surfaces will abut against each other in a coincident and planar fashion. Likewise, the upper surface of adapter 53 is substantially flat as is the lower surface of main body 51 such that those two surfaces will abut in a substantially coincident and planar fashion.

As is generally described in U.S. Pat. No. 5,067,464, there is a relationship between the fuel injection process and the time and action of the valve train cam acting on link 62. As will be described hereinafter with regard to the action of fuel transfer and movement within injector 50, the valve train cam displaces the link downwardly, deeper into coupling 55. With continued advancement of link 62 it contacts an interior abutment surface within coupling 55 which in turn contacts the timing plunger 63 with a compressive force. After the injection event, the valve train cam is positioned so as to allow the link 62 to lift up and away from coupling 55. Coupling 55 and link 62 are urged to follow the cam profile due to the force generated in the compressed return spring 64.

With regard to the more detailed teachings of the present invention, the fuel flow analysis begins with the cam on the outer base circle and with the timing plunger 63 and metering plunger 65 bottomed. In this condition the solenoid valve 56 is closed. As the cam begins to move toward the inner base circle the timing plunger 63 and coupling 55 move in an upward direction, urged to follow the cam in part due to return spring 64. Fuel at rail pressure of approximately 150 psi (104 N/cm$^2$) is supplied through check valve 66 into the cavity 67 below the metering plunger 65. When the desired fuel quantity has been metered the solenoid valve 56 is opened, allowing fuel at rail pressure into timing chamber 68. Fuel at rail pressure is provided above metering plunger 65 in chamber 68 as well as below the metering plunger 65. An additional force is applied by the bias spring 71 to stop any continued travel of the metering plunger 65. The force produced by the biased spring 71 assures that the ball of check valve 66 is fully seated and that the desired fuel quantity is trapped in cavity 67 below the metering plunger 65. As the timing plunger 63 continues its upward travel, the timing chamber 68 fills with fuel supplied via open solenoid valve 56.

When the cam begins its travel toward the outer base circle the fuel injection cycle begins. As previously outlined, this cam movement indirectly acts on timing plunger 63 causing it to travel ill a downward direction. The pushing or compression action on the fuel in chamber 68 results in some portion of the trapped fuel spilling from the timing chamber 68 back through the open solenoid valve 56 to rail. Next, to actually start injection, the solenoid valve is closed at a time which corresponds to a predetermined crankshaft angle. Closing of the solenoid valve 56 terminates the preignition back flow of the fuel to rail. A greater pressure is created in the timing chamber 68 which in turn applies a force to and through the metering plunger 65 which increases the pressure in cavity 67. Cavity 67 is flow coupled to cavity 72 within nozzle 54. The enlarged area 73 of cavity 72 intersects with the flow passage 74 and area 73 is adjacent to tile tapered interface between the major and minor needle diameters of needle 75.

When the pressure in cavity 72 acting on the tapered major—minor needle interface exceeds the preload force of spring 76, the needle 75 lifts and injection begins. The continued downward travel of metering plunger 65 forces the desired unit of fuel to be injected. The opening of metering spill port 79 allows the fuel in cavity 65 to empty to rail. This lowers the pressure in cavity 72 and when the pressure in cavity 72 is less than the downward force exerted by spring 76, the needle 75 drops, closing the nozzle 54 and ending the unit injection. The FIG. 3 illustration provides an enlarged detail of tile nozzle 54, needle 75 and spring 76 and details a button 77 positioned between the spring and the needle.

Even after the end of the injection cycle there is still some downward movement of metering plunger 65. This downward movement results in the opening of timing spill port 80 and the spilling of the fuel in timing chamber 68 to drain. The timing plunger 63 and metering plunger 65 move in a downward direction until bottomed, a condition which coincides with the cam at its maximum outer base circle travel.

Figure 3:
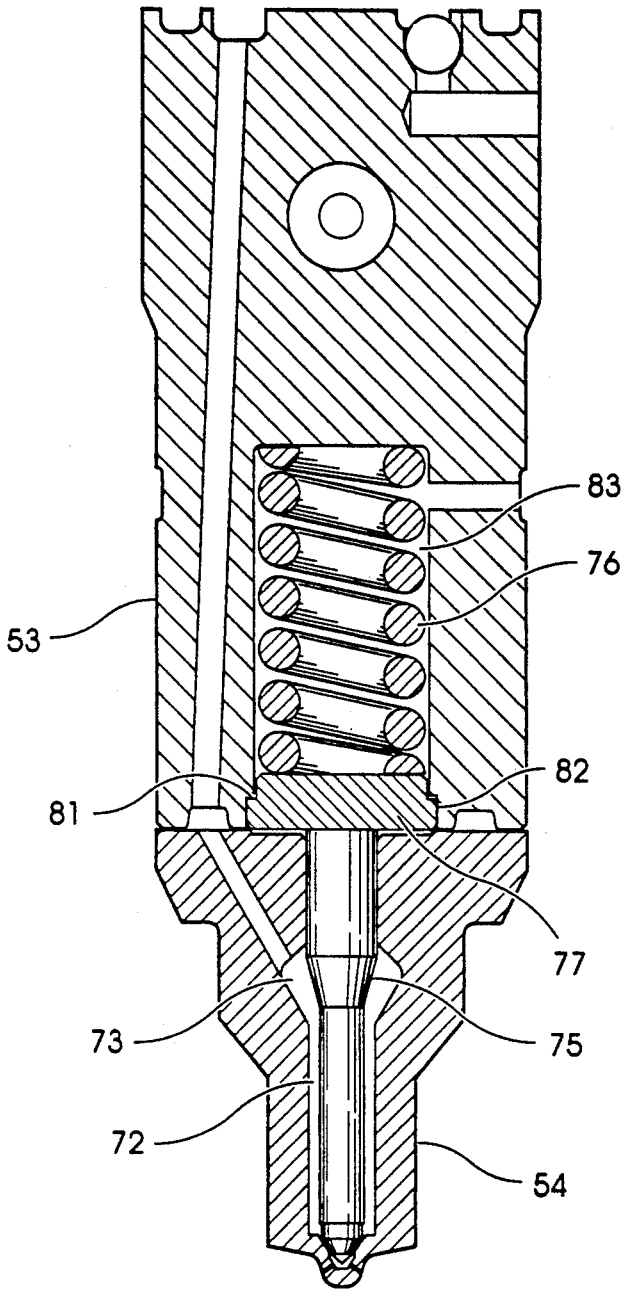
FIG. 3 is an enlarged, partial, front elevational view in full section of the injector needle and nozzle portion of the FIG. 2 injector.

Referring to the enlarged detail of FIG. 3, the nozzle/needle opening pressure is set by selecting the desired thickness of stepped button 77 which in turn determines the preload on spring 76 for a specific spring. This particular design approach eliminates the small diameter stem 38 typically present at the top of the needle. This small diameter stem is difficult and expensive to machine and its elimination provides a less costly injector design.

The step 81 in button 77 in cooperation with the undercut 82 in the wall of spring cavity 83 determines the needle 75 travel. As is illustrated, the stepped button includes two important functional surfaces. The top surface of the button is placed directly against the lower edge of spring 76 and thus the overall depth or thickness of the button controls the preload on the spring and thus the amount of force required for the needle to lift and injection to begin. The step 81 of button 77 has a height or thickness slightly below the depth of the counterbored surface which defines the lowermost outer wall portion of spring cavity 83. By properly sizing the outside diameter of the step 81 of button 77 relative to the counterbore diameter, it will be seen that the amount of clearance left between the horizontal counterbore edge and the top surface of step 81 controls the amount of movement possible for the needle 75 when it lifts. The lifting needle pushes up against button 77 which pushes up against the spring and the additional compression of the spring allows the needle to lift and injection to occur.

Figure 4:
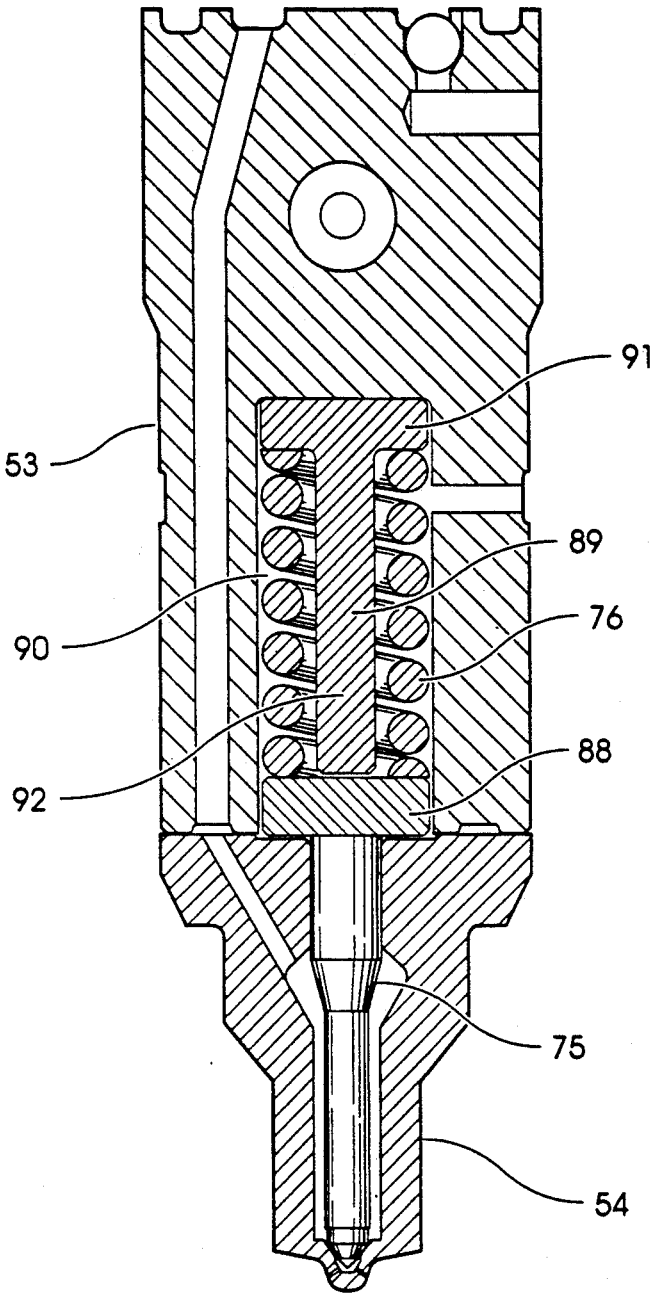
FIG. 4 is an enlarged, partial, front elevational view in full section of an alternative design of the present invention.

Referring to FIG. 4 there is illustrated an alternative construction to that of FIG. 3. In FIG. 4 the stepped button 77 of FIG. 3 is replaced with a straight-sided button 88. As would be understood, the lower portion of the spring cavity 90 is not counterbored and thus an alternate means of controlling the lift dimension for the needle must be provided. The lift of the needle is controlled in the FIG. 4 embodiment by the design and placement of plunger 89. Plunger 89 includes a head portion 91 and a stem portion 92 which extends down through the center of spring 76. The thickness of the head portion which is in contact with both the spring and the upper surface of the spring cavity may be used to set the preload or the spring by changing the thickness of the head portion. Alternatively, as well as in combination, the thickness of straight-sided button 88 may of used to set the preload on spring 76. The lift or travel of the needle is controlled by the distance of separation between the top surface of button 88 and the bottom surface of the stem portion.

The design of injector 50, with either button style (reference FIGS. 3 and 4), results in a number of cost saving measures compared to the design of the predecessor injector 20 as detailed in FIG. 1. A comparison of FIGS. 1 and 2 will reveal the elimination of certain parts from the FIG. 1 injector and the elimination of certain seal surfaces which are no longer necessary in the FIG. 2 injector design.

More specifically, the FIG. 2 of injector 50 as compared to the design of injector 20 (FIGS. 1, 1A and 1B) shows that the metering barrel 26, spacer 25 and spring cage 24 have collectively been replaced by a single component, adaptor 53. Reducing these three separate components down to a single component results in the elimination of the various pockets 46 and in the elimination of the four high pressure seal surfaces 47. By eliminating tile pockets the trapped volume of fuel is reduced and this reduction increases the hydraulic spring rate for increased efficiency. The one-piece design of adaptor 53 results in a more reliable design, a lower cost design and an overall better quality injector.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A fuel injector for an internal combustion engine comprising:

a main body having an axially-extending timing bore;

a timing plunger disposed within said axially-extending timing bore;

a nozzle member having an axially-extending needle bore;

an injection needle disposed in said axially-extending needle bore;

an adapter positioned between said nozzle member and said main body, said adapter including an axially-extending metering bore and a needle spring cavity;

a retainer disposed about said nozzle member and said adapter and attached to said main body;

a metering plunger disposed within said axially-extending metering bore;

a biasing spring disposed within said needle spring cavity; and control means for limiting the upward travel of said needle in response to the fuel pressure in said axially-extending needle bore.

2. The fuel injector of claim 1 wherein said control means includes a stepped button.

3. The fuel injector of claim 2 which further includes a counterbored sidewall surface as part of said needle spring cavity.

4. The fuel injector of claim 3 wherein said adapter is of a unitary, one-piece construction.

5. The fuel injector of claim 4 wherein said nozzle member has a substantially flat upper surface and said adapter has a substantially flat lower surface and wherein said upper and lower surfaces are in abutment with each other.

6. The fuel injector of claim 1 which further includes all electronically operated control valve cooperatively assembled to said main body.

7. The fuel injector of claim 6 wherein said control means includes a stepped button.

8. The fuel injector of claim 7 which further includes a counterbored sidewall surface as part of said needle spring cavity.

9. The fuel injector of claim 8 wherein said stepped button is disposed within said needle spring cavity and positioned adjacent said counterbored sidewall surface.

10. The fuel injector of claim 9 wherein said adapter is of a unitary, one-piece construction.

11. The fuel injector of claim 1 wherein said control means includes a button and plunger combination.

12. The fuel injector of claim 11 wherein said plunger includes a head portion overlaying a top end of said biasing spring and a stem portion extending into said biasing spring.

13. The fuel injector of claim 12 wherein said button is positioned below said biasing spring opposite to said top end.

14. The fuel injector of claim 13 wherein the thickness of said head portion sets the preload on the biasing spring which preload must be overcome by the fuel pressure for the needle to lift.

15. The fuel injector of claim 13 wherein the thickness of said button sets the preload on the biasing spring which preload must be overcome by the fuel pressure for the needle to lift.

16. A fuel injector for an internal combustion engine comprising:

a main body having an axially-extending timing bore;

a timing plunger disposed within said axially-extending timing bore;

an adapter operably attached to said main body and including an axially-extending metering bore, a metering cavity at the base of said metering bore and a needle spring cavity;

needle-controlled injection means including a needle for controlling the injection of fuel which is delivered to said needle-controlled injection means from said metering cavity;

a biasing spring disposed within said needle spring cavity; and control means for limiting the upward travel of said needle in response to the fuel pressure present in said needle-controlled injection means.

17. The fuel injector of claim 16 wherein said control means includes a stepped button.

18. The fuel injector of claim 17 which further includes a counterbored sidewall surface as part of said needle spring cavity.

19. The fuel injector of claim 18 wherein said adapter is of a unitary, one-piece construction.

20. The fuel injector of claim 16 which further includes an electronically operated control valve cooperatively assembled to said main body.

21. The fuel injector of claim 20 wherein said control means includes a stepped button.

22. The fuel injector of claim 16 wherein said needle-controlled injection means includes a nozzle member having an axially-extending needle bore, said needle being disposed in said axially-extending needle bore.

* * * * *

UNITED STATES PATENT AND TRADEMARK OFFICE

CERTIFICATE OF CORRECTION

PATENT NO. : 5,333,786

DATED : August 2, 1994

INVENTOR(S) : Gary L. Gant, et al.

It is certified that error appears in the above-indentified patent and that said Letters Patent is hereby corrected as shown below:

In Col. 1, at line 8, "tile" should be --the--.

In Col. 3, at line 7, "differinq" should be --differing--.

In Col. 3, at line 47, "stein" should be --stem--.

In Col. 3, at line 52, "of" should be --or--.

In Col. 4, at line 17, "tot" should be --for--.

In Col. 5, at line 24, "ill" should be --in--.

In Col. 5, at line 38, "tile" should be --the--.

In Col. 5, at line 51, "tile" should be --the--.

In Col. 6, at line 40, "of" should be --be--.

UNITED STATES PATENT AND TRADEMARK OFFICE

CERTIFICATE OF CORRECTION

PATENT NO. : 5,333,786

DATED : August 2, 1994

INVENTOR(S) : Gary L. Gant, et al.

It is certified that error appears in the above-indentified patent and that said Letters Patent is hereby corrected as shown below:

In Col. 6, at line 60, "tile" should be --the--.

In Col. 7, at line 41, "all" should be --an--.

Signed and Sealed this

Twenty-fifth Day of October, 1994

*Attest:*

Bruce Lehman

BRUCE LEHMAN

*Attesting Officer*

*Commissioner of Patents and Trademarks*